United States Patent [19]

Chang

[11] 4,149,108

[45] Apr. 10, 1979

[54] MULTISTABLE CATHODE RAY TYPE STORAGE DISPLAY DEVICE

[75] Inventor: Ifay F. Chang, Mahopac, N.Y.

[73] Assignee: International Business Machines Corporation, Armonk, N.Y.

[21] Appl. No.: 807,753

[22] Filed: Jun. 17, 1977

[51] Int. Cl.[2] ..... H01J 31/06; H01J 31/58

[52] U.S. Cl. ..... 315/8.5; 313/391; 313/397; 313/463

[58] Field of Search ..... 313/391, 392, 394, 397, 313/399, 400, 463; 315/8.5; 340/324 A

[56] References Cited

U.S. PATENT DOCUMENTS 3,796,909 3/1974 Chang et al. ..... 340/166 EL

OTHER PUBLICATIONS

"Inherent Memory Effects in ZnS:Mn Thin Film EL Devices", Yamauchi et al., Int'l. Electron Devices Mtg. Digest, pp. 348-351, Dec. 1974.

*Primary Examiner*—Alfred E. Smith
*Assistant Examiner*—Robert E. Wise
*Attorney, Agent, or Firm*—Hansel L. McGee

[57] ABSTRACT

A multistable or memory electron beam addressed electroluminescent display panel is provided. The display panel is electron beam activated in the presence of an A. C. field, without the need of prior art flood guns. The panel may be activated or switched by direct electron beam activation of an electroluminescent film or by electron beam induced light radiation from a cathodoluminescent layer or from an insulating layer.

9 Claims, 6 Drawing Figures

MULTISTABLE CATHODE RAY TYPE STORAGE DISPLAY DEVICE

BACKGROUND OF THE INVENTION

1. Field of the Invention

The invention relates to a novel multistable electron beam addressed electroluminescent storage display panel. More particularly, it relates to a storage display panel which can be activated by direct electron beam radiation in the presence of an A.C. field via direct electron beam activation of an electroluminescent film or by electron beam induced light activation of said electroluminescent film.

2. Prior Art

For computer display often large information content is involved, the refresh cathode ray tubes require a large memory which is costly. For instance, to display a 8000 character text, a storage memory of $5 \times 10^5$ bits is required. Thus there is a need for a memory display device which contains internal memory. None of the present day CRT devices except complex flood gun structures meet the memory requirements aforementioned.

There have been several attempts to fabricate storage CRT's to meet the above-stated requirements. Until the present invention none of the CRT's presently in use approached these requirements.

What is perhaps the most recent advance in electroluminescent bistable storage display devices is described in U.S. Pat. No. 3,796,909 to Chang et al. This device is innovative in that it describes a storage display concept wherein an A.C. field-sensitive material is used as the display medium. A secondary electron emitting layer is used for storage medium. An image is displayed by electroluminescence rather than from cathodoluminescence as in some earlier prior art devices. In this device a charge pattern is written on an electroluminescent target by a "writing" electron beam. This "written charge pattern" electron beam is maintained by a "flood" electron beam via a secondary electron emission process to establish a voltage pattern corresponding to the written charge pattern. An A.C. potential is applied to the electroluminescent target via a transparent electrode on the face-plate. The A.C. potential produces an A.C. field in the electroluminescent target only in the region where its inner surface is maintained at a fixed collector potential by the flood electron beam. Thus, the electroluminescent image is generated according to a stored charged pattern. This has the advantage of improved brightness, because the electroluminescent target is not dependent on the flood beam potential and can be independently adjusted by varying the A.C. voltage and frequency as the flood beam is maintaining the bistability. The major drawbacks of this device are that much of the flood beam energy is dissipated from the face-plate as heat. Moreover, the device exhibits bistability only, which limits usefulness of display. In many display applications such as business graphing matrix displays and text editing displays, it is desirable to have multilevel intensities (brightness) so that images of gray scale and intensity modulation (either for information coding purpose or attention getting purpose), can be displayed.

A more recent discovery, the A.C. field sensitive electroluminescent displays has been made by P. Inoguchi et al, Digest 1974 Society for Information Display International Symposium, Los Angeles, 1974 p. 84.

More recent studies of this recent discovery have been made by Yamauchi et al., IEEE, 1974 IEDM Digest, and C. Suzaki et al., Digest, 1976, Society for Information Display International Symposium, Los Angeles 1976 p. 50. P. Inoguchi et al., discovered that an electroluminescent target can be biased with a sustaining A.C. voltage below its normal threshold voltage and can be subsequently activated or switched to an on state by applying a light pulse. Because of the hysteresis loop characteristics of this type electroluminescent device there is exhibited multistability or memory. The light pulses are effected by a high pressure mercury lamp.

What has been discovered in the present application is that a CRT can be fabricated which has memory or gray scale functions. It has been further discovered that the electroluminescent target can be directly activated by electron beam, or alternately, by light induced by electron beam radiation. Since the mechanism of both the electron beam switching and light switching are not known to workers in the field of electroluminescence and displays, the discovery of electron beam switching, particularly, in a serial manner, is not like exposing the entire device to an optical image simultaneously to achieve optical switching, nor like exposing the entire device to flood beam electrons which are required to maintain a fixed voltage over the high energy beam written pattern serving as an AC voltage reference.

SUMMARY OF THE INVENTION

In accordance with the principles of the present invention an improved sensitive A.C. field multistable electroluminescent CRT sandwiched between two electrodes is provided. The electroluminescent target of the CRT can be switched or activated to an on state by direct electron beam excitation or by light emission induced by electron beam radiations one point at a time in random access. The intensity of an activated state depends on the current level of the direct electron beam.

It is therefore an object of the present invention to provide an improved A.C. field sensitive electroluminescent storage CRT.

It is a further object of the present invention to provide an improved A.C. field sensitive multistable electroluminescent CRT which can be activated by direct electron beam radiation.

It is still another object of the invention to provide an improved A.C. field sensitive multistable electroluminescent CRT which can be activated by electron beam radiation induced light.

And yet another object of the invention is to provide an improved A.C. field sensitive multistable electroluminescent CRT having analog memory and gray scale capability.

The foregoing objects, features and advantages of the invention will be apparent from the following more particular description of the preferred embodiments of the invention as illustrated in the accompanying drawings.

DETAILED DESCRIPTION OF THE DRAWINGS

Figure 1:
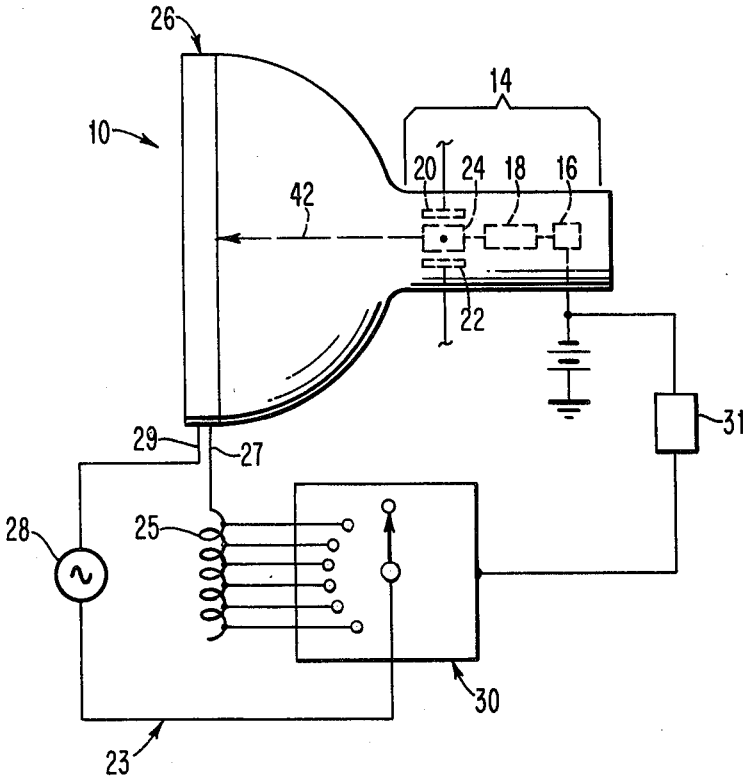
FIG. 1 shows the improved CRT having at its viewing face the electroluminescent target of the present invention.

In FIG. 1, there is shown an embodied configuration of the multistable electroluminescent CRT display tube in accordance with the principles of the present invention. In general, the overall configuration of the cathode ray type tube is similar to any of a variety of cathode ray type tubes, employed in the prior art. Typically, the storage tube shown generally as 10 would have an face plate 12 made of glass. In addition the high energy electron writing gun shown generally as 14 comprises a conventional configuration, well known to those skilled in the art. In particular, it can be seen that high energy electron source 16 acts to emit high energy electrons through focusing element 18 to the vertical and horizontal fields created by deflection plates shown at 20, 22 and 24. As can be seen, plates 20 and 22 act to vertically deflect the high energy electron beam while plate 24, 24' another plate not shown, acts to horizontally deflect the electron beam. Alternatively, magnetic deflection and magnetic focus can be used. Absent from the present invention are the flood guns necessary to the prior art bistable storage tube, since area flood electron beams are not used to generate high brightness display nor to maintain a stored charge pattern.

Similarly, the display screen or panel shown in FIG. 1 generally as 26 differs from that of the prior art bistable storage tubes. The electroluminescent target is sandwiched between two conducting electrodes. In addition to the typical electroluminescent layer in accordance with preferred embodiments of the present invention, there may also be included a layer of cathodoluminescent material or an insulating material which can be induced to emit high energy radiation in a random access manner when exposed to electron beam radiation. Thus, there is also not present in the invention an independent light source.

Different from the prior art bistable storage display tube, an A.C. field is maintained across display panel 26 via A.C. source 28 via leads 27 and 29 connecting to two conducting plane electrodes. Typically, the A.C. source 28 can be a sinusoidal wave generator or an A.C. pulse generator. It must be capable of supplying from 0 volts to at least 300 volts.

Switching arrangement 30 is provided to vary the inductance 25 of resonant circuit 23 according to exact capacitive load of the face-plate, so that the electroluminescent face-plate may be operated at optimum frequency. The resonant circuit drive scheme is commonly used to minimize power dissipation. One can either use a parallel L-C or a series L-C circuit to achieve this purpose. The frequency used in the A.C. source 28 must be the resonant frequency, $$f = \frac{1}{2\pi}\,\frac{1}{\sqrt{LC}}\sqrt{\frac{CR_L^2 - L}{CR_C^2 - L}} \text{ (parallel } L\text{-}C\text{) or}$$

$$f = \frac{1}{2\pi}\,\frac{1}{\sqrt{LC}} \text{ (series } L\text{-}C\text{).}$$

The switch 30 can be manually controlled by the operator to obtain the resonance condition.

Figure 2A:
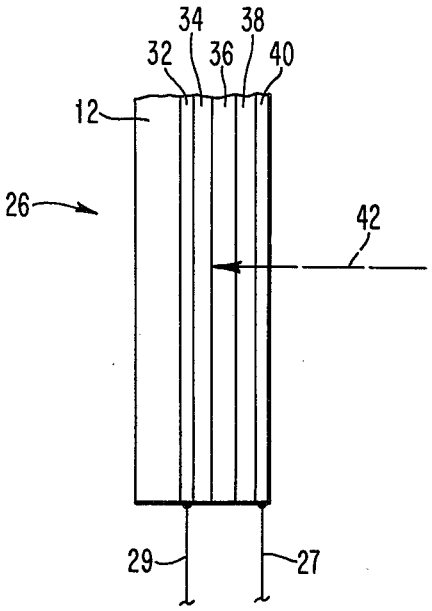
FIG. 2*a* shows in detail, the construction of the electroluminescent target which is directly activated by electron beam radiation.

In FIGS. 2*a*–2*d* there are shown several embodiments contemplated by the present invention. In FIG. 2*a* for example, there is shown a display panel 26 comprising face-plate 12 having deposited thereon a conductive layer 32. Conductive layer 32 can be a transparent conductor fashioned from $SnO_2$ or $In_2O_3$. Contiguous to layer 32 is an insulating layer 34, which can be fashioned from titanates, oxides and nitrides. Typically, the insulating layer may be selected from $BaTiO_3$, $SrTiO_3$, $Al_2O_3$, $Y_2O_3$, $Si_3N_4$ and AlN and is transparent. Deposited on layer 34 is an electroluminescent layer 36. Electroluminescent layer 36 may comprise any of a variety of well known electroluminescent materials. Preferably, layer 36 comprises an electroluminescent polycrystalline thin film. For example, layer 36 may comprise Cu or Mn doped ZnS uniformly deposited on insulating layer 34. Alternatively powdered electroluminescent materials may be employed. Exemplary of the electroluminescent materials that may be employed and methods of fabricating same, are described by Blazey et al. in U.S. Pat. No. 3,313,652.

A second insulating layer 38 is contiguous with layer 36 and can be of the same or different material as insulating layer 34. A second conductive layer 40 is disposed upon insulating layer 38. This layer can be a thin transparent or non-transparent film of $SnO_2$, $In_2O_3$, Al, Cu, Ag, Au or etched thin metal layers. Likewise thin layers of copper iodide can be employed.

In the configuration in FIG. 2*a*, described above, the panel is accessed randomly and operated directly by the penetration of electrons, illustrated by arrow 42, to electroluminescent layer 36. Such penetration activates the storage mechanism. Although the storage mechanism is not exactly known, it is possible. The incoming electrons or the secondary electrons and light radiation induced by the electron beam excite the trapping states or charge storage levels in the electroluminescent material. The excited charges are polarized under the biased field to result in an internal field. The internal field aids the external field in exciting the electroluminescence.

Figure 2B:
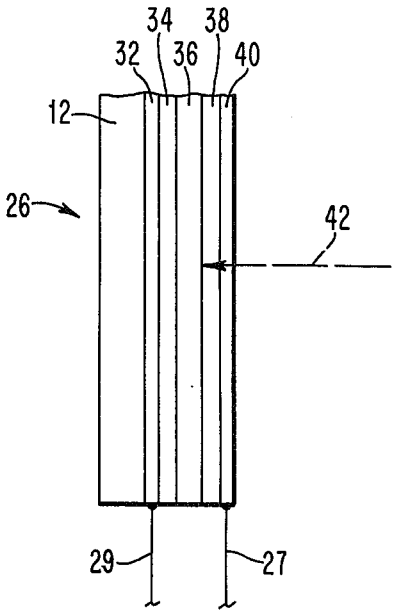
FIG. 2*b* shows in detail, the construction of the electroluminescent target which is activated by electron beam induced light emanating from an insulating layer.

In FIG. 2*b* there is shown a configuration similar to that shown in FIG. 2*a*. In this configuration second insulating layer 38 is composed of a material which is both insulating and cathodoluminescent. For the operation of this invention, the cathodoluminescence referred to here need not to be visible as in cathodoluminescent CRT display. The material generally emits light in the UV and blue wavelengths of the spectrum. One example of such material is AlN, which is an efficient UV light emitter. Many other wide band gap materials such as metal oxides and metal tungstates may also be used. In the embodiment of the invention shown in FIG. 2*b* the electron beam (42) penetrates only to layer 38 which emits high energy photons. These high energy photons activate the electroluminescent storage mechanism in layer 36.

Figure 2C:
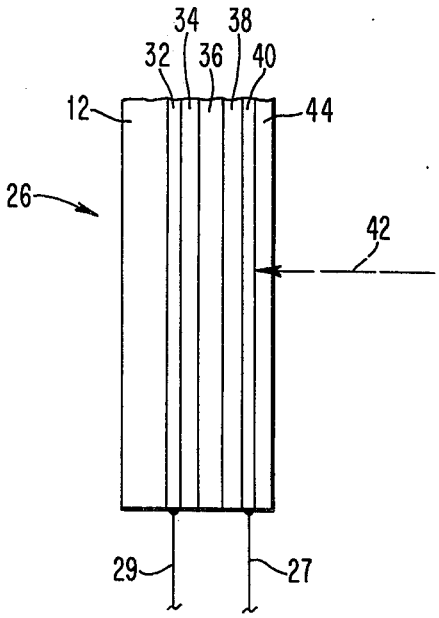
FIG. 2*c* shows in detail, the construction of the electroluminescent target which is activated by electron beam induced light emanating from a cathodoluminescent layer.

In FIG. 2c there is shown yet another embodiment of the invention. Here there is added a cathodoluminescent phosphor layer 44 adjacent to conductive layer 40. Contrary to electroluminescent material which exhibits luminescence in response to an alternating field applied thereacross, cathodoluminescent materials exhibit luminescence in response to impingement of electrons on the surface thereof as known in the art. Examples of cathodoluminescent phosphors which may be used in the present invention include, barium zinc magnesium silicate:Pb, strontium hexaborate:Pb, ZnCdS:Cu, $ZnSiO_4$:Mn, ZnS:Ag, ZnO:Zn and the like. As shown in FIG. 2c, the electron beam 42 penetrates only to cathodoluminescent layer 44 whereby said layer 44 is caused to emit high energy photons which in turn activate the electroluminescent storage mechanism in layer 36. For the purpose of activating the storage mechanism in the electroluminescent device, the cathodoluminescence from layer 44 induced by high energy electron beam is preferred to be in the ultra violet.

Figure 2D:
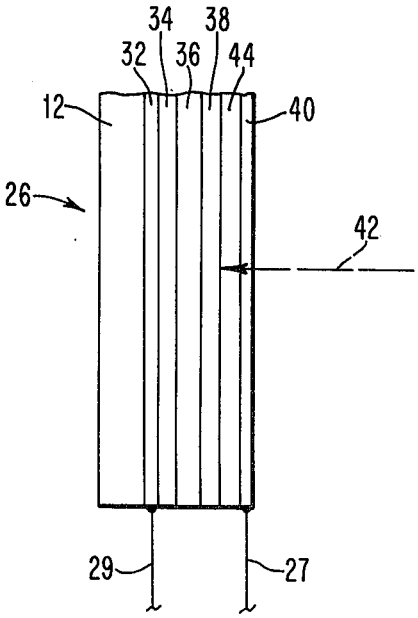
FIG. 2*d* shows the detail construction of the electroluminescent target shown in FIG. 2*c* except for the rearrangement of the cathodoluminescent layer and electrode.

In FIG. 2d there is shown a similar configuration to that of FIG. 2c except that layers 44 and 40 are interposed. This arrangement provides a tradeoff between lower energy electrons and ease of activating the electroluminescent layer 36. In the case where layer 44 is a cathodoluminescent insulator layer 38 can be omitted in FIG. 2d.

IN OPERATION

Figure 3:
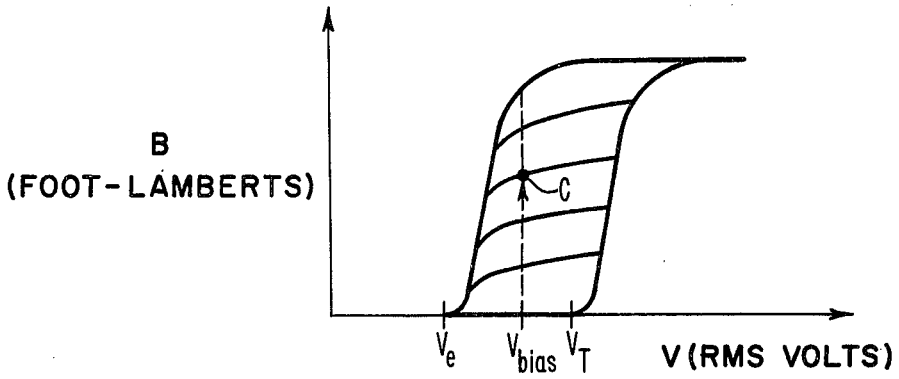
FIG. 3 illustrates the brightness of the on state (written points by direct electron excitation) of the electroluminescent panel.

An AC voltage, $V_{bias}$ from AC source 28 is applied across electroluminescent layer 36 via conductors 32 and 40. The voltage level is biased above the extinction voltage, $V_e$ and below the turn-on threshold voltage, $V_t$ as shown in FIG. 3. Which illustrates the brightness of the on state of (written points by direct electron excitation) the electroluminescent panel. The different levels of brightness (grey scale) can be obtained at a given AC bias voltage, $V_{bias}$, by giving the target a single shot of electron beam of appropriate electron voltage, electron beam current or electron beam dwelling time. These three parameters can be varied to produce a single shot of desired electron energy which activates the desired impedance change in the electroluminescent device which in turn produces a desired brightness level for a given bias voltage.

For typical electroluminescent face plates the threshold voltage $V_t$ range is typically 50 V to 300 V (RMS) and the extinction voltage $V_e$ is typically 0 to 270 V (RMS) depending on the layer thickness of the electroluminescent device.

Generally, the bias voltage is not sufficient to cause any appreciable electroluminescence before electron excitations. When excited by electrons (and/or photons or secondary electrons generated by electrons) the conductivity of the electroluminescent layer 36 is increased (or viewed as the threshold voltage is decreased) so that more current is flowing through and more light emission occurs. The higher current flow also establishes an internal polarization which aids the AC voltage in phase to generate more electroluminescence. Thus, the device is switched to the higher conducting state and, through the internal polarization field (switched in phase with external applied field), the device is operated in a stable memory state. The AC voltage can be supplied by a sinusoidal wave generator or an AC pulse generator. Since the electroluminescent device is a capacitive load, it is advantageous to use a parallel or series L-C (inductance and capacitance) resonant circuit 23 (FIG. 1) drive scheme. The inductance 25 can be varied according to the capacitive load of faceplate 12, i.e. proportional to the area of faceplate which is turned on. One method of obtaining this type of resonant tuning is to monitor the CRT grid voltage. When the grid voltage is in an off mode, no electrons can be emitted out of the CRT gun 14; thus, no faceplate area can be excited or turned on. Conversely, when the grid voltage is turned on, the electrons are allowed to reach the faceplate 12. Therefore, by monitoring the grid voltage and the deflection signal, one can keep track of how much faceplate area is in the on state and switch the proper amount of inductance into the resonance circuit. In the resonant drive mode, power dissipation is minimized.

The present device is a random accessable storage display with grey scale or multilevel intensity capability. In order to display grey scale or multilevel intensities, one simply switches on the electron beam with different current density and/or different dwell time and deflects it to the desired spot on the screen only once. This is different from a conventional refreshed CRT in which a video signal is applied to the control grid to modulate the electron beam intensity in synchronism with the deflection signal so that the same intensity beam occurs at the same spot in a cyclic refreshed manner. The present device does not require such a high frequency video signal modulation cyclicly in synchronism with the deflection signal. In addition one has the freedom to vary the amplitude and frequency of the biasing AC field to obtain different intensity levels for contrast improvements under certain ambient conditions.

What is claimed is:

1. An improved cathode ray tube storage display device including a high energy electron write gun, a display panel and means for applying an A.C. field across said display panel, the improvement being;

said display panel having the capability of being activated by direct electron beam activation of an electroluminescent film and by electron beam induced light radiation from a layer of the display panel and means included in said panel to produce a multistable image at selected points thereon by direct electron beam activation from said high energy electron write gun.

2. The display device as set forth in claim 1 wherein said display panel comprises;

a faceplate having disposed thereon a conductive layer, contiguous to said conductive layer is an insulating layer on which there is disposed a layer of an electroluminescent material which can be activated by direct electron beam radiation, disposed on said electroluminescent layer is a second insulating layer having disposed thereon a second conductive layer.

3. The display device as set forth in claim 2 wherein said electroluminescent layer is directly activated by electron beam radiation.

4. The display device as set forth in claim 2 wherein said electroluminescent layer is activated by electron beam induced high energy radiation.

5. The display device as set forth in claim 2 wherein there is disposed on said second conductive layer, a layer of a cathodoluminescent material, said cathodoluminescent layer serving to emit high energy radiation when exposed to electron beam radiation thereby activating said electroluminescent layer.

6. The display device as set forth in claim 4 wherein said electron beam induced high energy radiation emanates from said second insulating layer.

7. A method of operating an improved cathode ray type storage and display tube device having a high energy electron write gun, a display panel, capable of being activated by direct electron beam activation of an electroluminescent film and by electron beam induced light radiation from said electroluminescent film, means for applying an A.C. signal across said display panel and means included in said display panel to produce a multistable image at randomly selected points thereon by direct electron beam activation from said high energy electron write gun, including the steps of a. directly activating said display panel by applying an electron beam thereon from said electron write gun, and b. modulating the amplitude and frequency of said A.C. field in accordance with a data signal input to thereby provide gray scale images on said display panel.

8. A method as set forth in claim 7 wherein there is added the step of impinging an electron beam from said electron write gun directly onto an electroluminescent layer of said display panel thereby activating said layer.

9. A method as set forth in claim 7 wherein there is added the step of impinging an electronic beam from said electron write gun onto a cathodoluminescent layer in said display panel thereby inducing said cathodoluminescent layer to emit high energy radiation to activate an electroluminescent layer in said display panel.

* * * * *